US010037747B1

(12) United States Patent
Lenz

(10) Patent No.: US 10,037,747 B1
(45) Date of Patent: Jul. 31, 2018

(54) PERIPHERAL DRUM QUICK MOUNT IDIOPHONE AND ASSOCIATED FLEXIBLE DRUM STICKS

(71) Applicant: Michael Lenz, Aurora, CO (US)

(72) Inventor: Michael Lenz, Aurora, CO (US)

( * ) Notice: Subject to any disclaimer, the term of this patent is extended or adjusted under 35 U.S.C. 154(b) by 0 days.

(21) Appl. No.: 15/610,043

(22) Filed: May 31, 2017

(51) Int. Cl.
*G10D 13/06* (2006.01)
*G10D 13/02* (2006.01)

(52) U.S. Cl.
CPC ..... *G10D 13/06* (2013.01); *G10D 13/02* (2013.01)

(58) Field of Classification Search
CPC ..... G10D 13/06
See application file for complete search history.

(56) References Cited

U.S. PATENT DOCUMENTS 1,416,522 A * 5/1922 Straight ..... G10D 13/06 248/207
1,607,769 A * 11/1926 Meyer ..... G10D 13/06 248/298.1
3,227,414 A * 1/1966 Dean ..... A47B 23/004 248/287.1
3,439,572 A * 4/1969 Cohen ..... G10D 13/06 446/422
3,490,410 A * 1/1970 Crawford, Sr. ..... G10D 13/06 116/67 R
3,859,886 A * 1/1975 Brisco, Sr. ..... G10D 13/06 273/DIG. 19
4,466,596 A * 8/1984 Cohen ..... G10G 5/00 248/231.41
D298,543 S * 11/1988 Benson ..... 84/402
4,898,061 A * 2/1990 Cohen ..... G10D 13/06 84/402
4,981,065 A * 1/1991 Cohen ..... G10K 1/071 84/402
D318,680 S * 7/1991 Cohen ..... D17/22
D321,528 S * 11/1991 Cohen ..... D17/22
5,703,306 A * 12/1997 Liao ..... F16M 13/02 248/229.11
6,245,980 B1 * 6/2001 May ..... G10D 13/06 84/422.2
6,673,993 B2 * 1/2004 Miller ..... G10D 13/02 84/411 R
6,815,598 B1 * 11/2004 Liao ..... G10D 13/06 84/327
7,071,400 B1 * 7/2006 Lombardi ..... G10D 13/006 84/402
7,148,412 B2 * 12/2006 Crane ..... G10D 13/00 84/402

(Continued)

*Primary Examiner* — Robert W Horn
(74) *Attorney, Agent, or Firm* — Leyendecker & Lemire

(57) ABSTRACT

A idiophone assembly for attachment to a rim or side of a drum comprising a idiophone, one or more quick release drum rim clamps and one or more fasteners and, as applicable, associated bosses for securing the clamps to the instrument is described. Advantageously, the assembly can be easily secured to the rim of a drum and easily removed from the drum as desired. In some variations, rubber insulating spacers are provided that at least partially acoustically isolate the instrument from the drum. The assembly is often positioned where it can be struck independently or in unison with the drum head to produce a rimshot or cross stick. A flexible drum stick is also described having two striking ends and a movable handle.

19 Claims, 13 Drawing Sheets

(56) References Cited

U.S. PATENT DOCUMENTS

| | | | | |
|---|---|---|---|---|
| 7,265,282 | B2 * | 9/2007 | Membreno | G10G 7/02 84/453 |
| 7,348,478 | B1 * | 3/2008 | Lombardi | G10D 13/06 84/402 |
| 7,358,431 | B1 * | 4/2008 | Monk | G10D 13/06 84/402 |
| 7,368,648 | B2 * | 5/2008 | van der Meulen | G10D 13/06 84/402 |
| 7,399,916 | B1 * | 7/2008 | Lombardi | G10D 13/06 84/422.1 |
| 8,403,280 | B2 * | 3/2013 | Halverson | H04R 1/08 248/228.5 |
| 8,476,514 | B2 * | 7/2013 | Dietz | G10D 13/06 84/402 |
| 8,853,511 | B2 * | 10/2014 | DePue, Jr. | G10D 3/00 84/274 |
| 9,390,694 | B2 * | 7/2016 | Berlinger | G10D 13/029 |
| 9,583,083 | B1 * | 2/2017 | Berlinger | G10D 13/029 |
| 2003/0000366 | A1 | 1/2003 | Miller | |
| 2009/0193957 | A1 * | 8/2009 | Lin | G10D 13/06 84/404 |
| 2014/0137719 | A1 * | 5/2014 | Wagstaff-Walker | G10D 13/06 84/402 |
| 2016/0112786 | A1 * | 4/2016 | Murata | H04R 1/08 248/231.51 |

* cited by examiner

PERIPHERAL DRUM QUICK MOUNT IDIOPHONE AND ASSOCIATED FLEXIBLE DRUM STICKS

BACKGROUND

Idiophones, such as blocks, bells, shakers, tambourines, castanets, guiros and others, are often used by percussionists to create characteristic sounds that may be desirable in the performance of a musical composition. Often the instruments are hand held and picked up by a percussionist only when needed. However, handheld idiophones are often not suitable or practical for use by drummers who cannot pick up the instrument, play one or more notes, and subsequently resume drumming in the time required by a piece. Accordingly, some idiophones are known that mount to a pole stand or lay on a table that can be conveniently situated relative to the drummer so that he/she may strike the instrument with his/her drum stick as required. These instruments are provided in a variety of sizes and configurations and can be comprised of various materials such as wood, plastic, metal and natural materials.

Prior drum-mounted sounding blocks are known that are attached to the side of a drum by way of brackets that have a hole that is received in the shaft of the drum head tensioning screw between the top surface of a drum's rim and the head of the tensioning screw. Mounting the instrument to the rim of the drum puts the instrument in a location the drummer is accustomed to and enables the drummer to expand on characteristic sound capabilities by enabling rapid alternate striking of the drum head and instrument, striking them both simultaneously creating a rimshot or setting one end of the drum stick on the drumhead while striking the instrument to create a cross stick. In its typical configuration, two brackets are utilized requiring the block assembly to be attached to the drum by way of two tensioning screws. Peripheral drum attachments often need to be removed for transporting and reattached for performances, but the nature of the attachment means utilized in prior art blocks prohibits the quick attachment, unattachment and/or relocation of the block to different locations on a particular drum without having to detension and subsequently retension the head. Moving the block to another drum is also time consuming.

Creating a rimshot can be difficult for experienced drummers let alone neophytes. It requires significant precision in the strike angle to nearly simultaneously hit both the rim or rim-mounted sounding block and the drum head. The rigidity of common prior art drumsticks do not permit much variance while still producing the desired effect.

DETAILED DESCRIPTION

Figure 1:
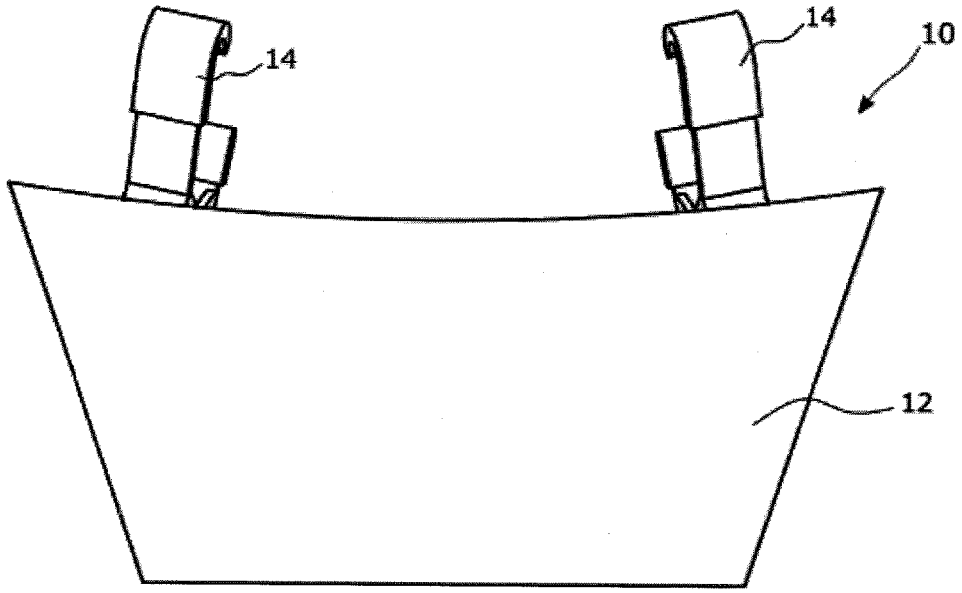
FIG. 1 is a front view of the sounding block assembly according to a first embodiment of the present invention.
Figure 2:
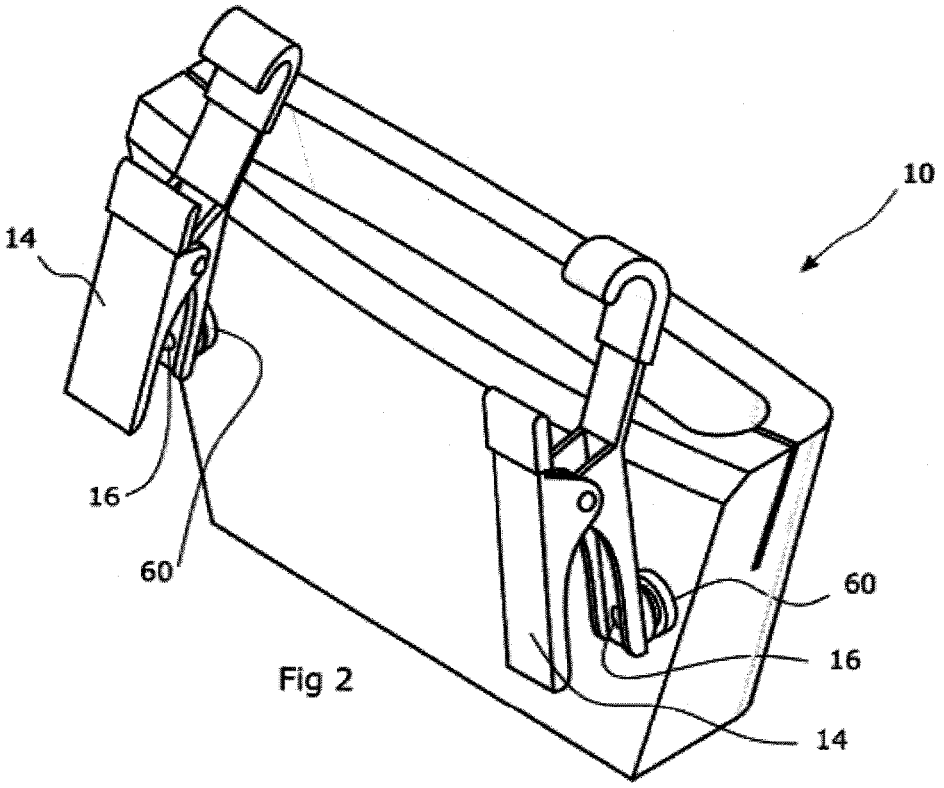
FIG. 2 is a perspective top rear view of the sounding block assembly according to a first embodiment of the present invention.
Figure 3:
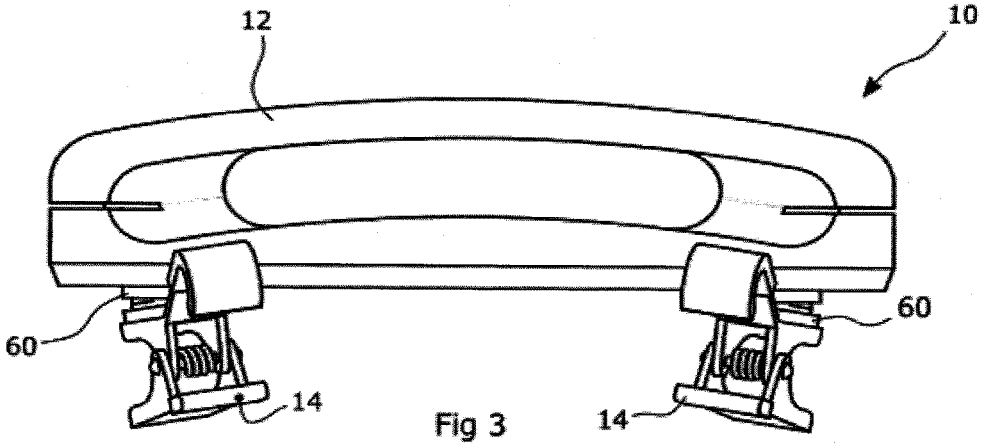
FIG. 3 is a top view of the sounding block assembly according to a first embodiment of the present invention.
Figure 4:
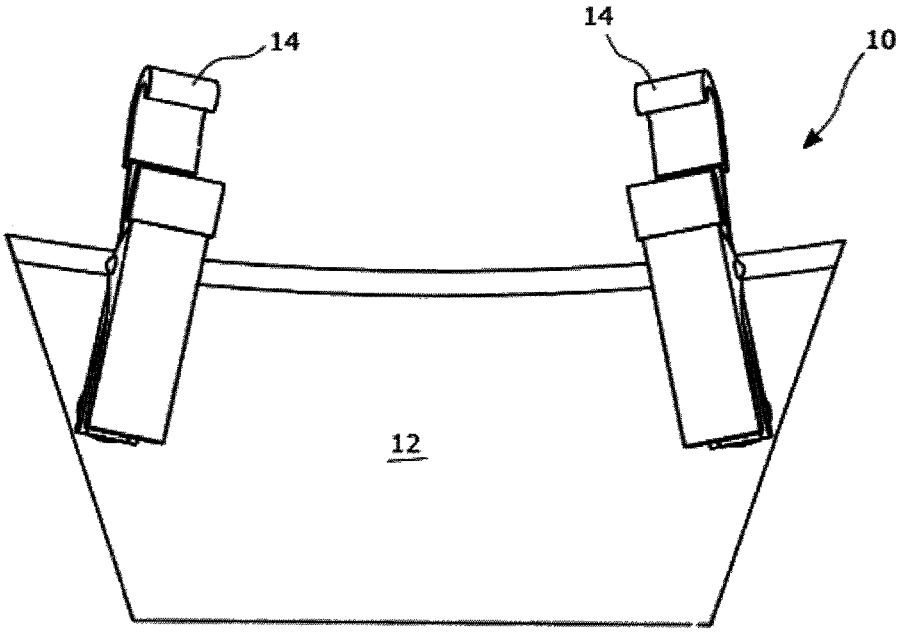
FIG. 4 is a rear (or back) view of the sounding block assembly according to a first embodiment of the present invention.
Figure 5:
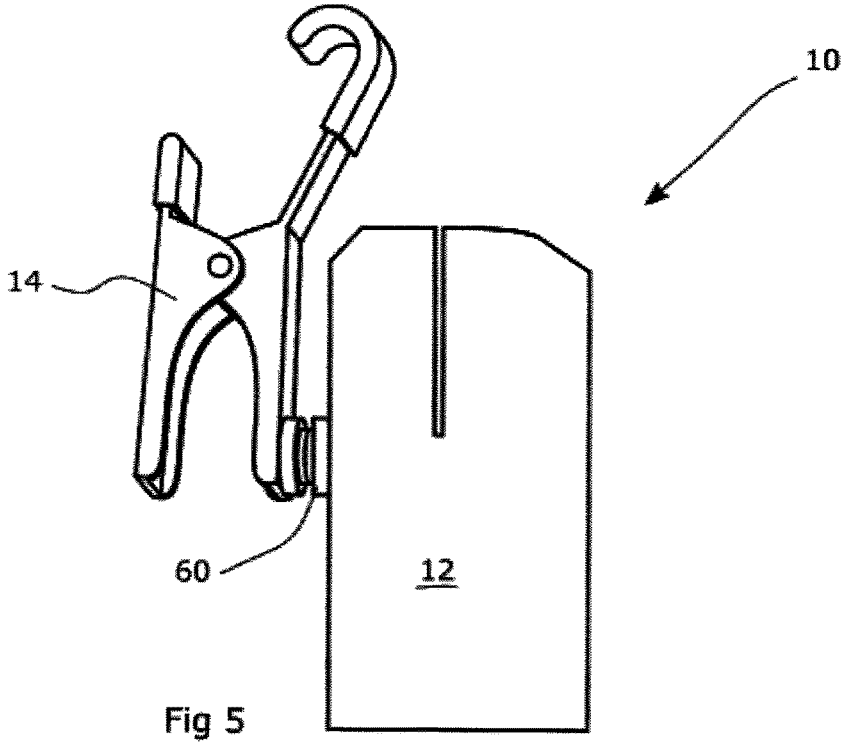
FIG. 5 is a side view of the sounding block assembly according to a first embodiment of the present invention.
Figure 6:
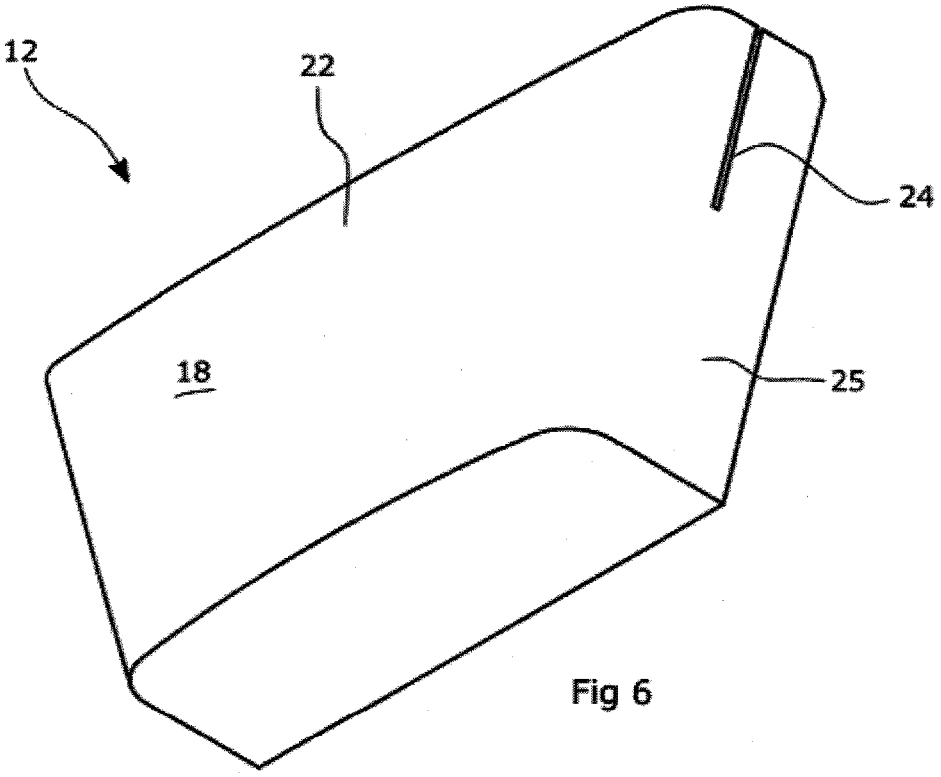
FIG. 6 is a perspective bottom front view of the block of the sounding block assembly according to a first embodiment of the present invention.
Figure 7:
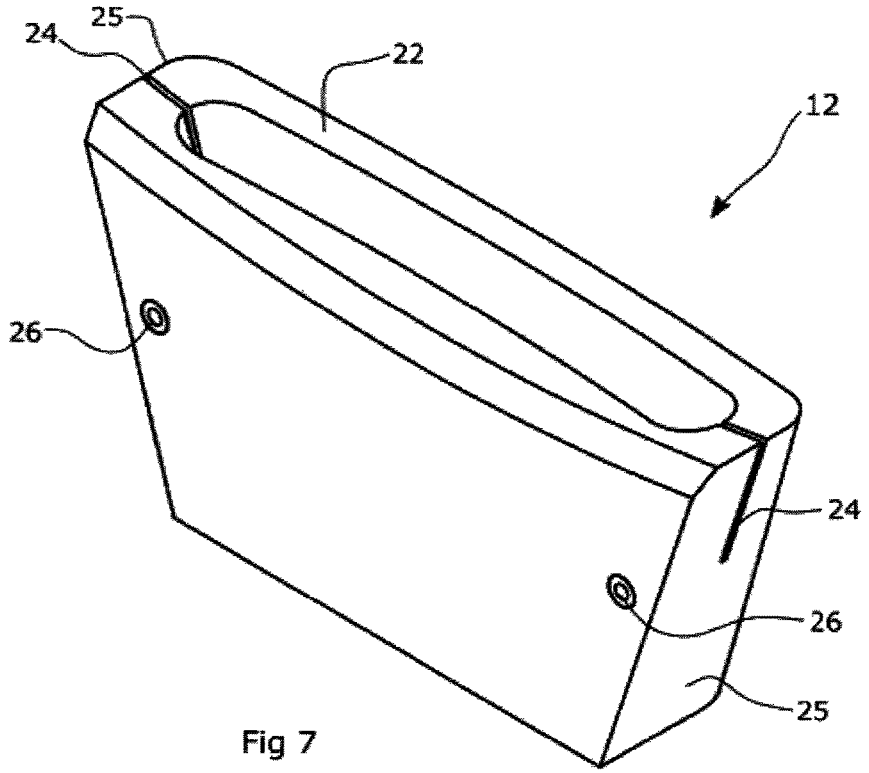
FIG. 7 is a perspective top rear view of the block of the sounding block assembly according to a first embodiment of the present invention.
Figure 8:
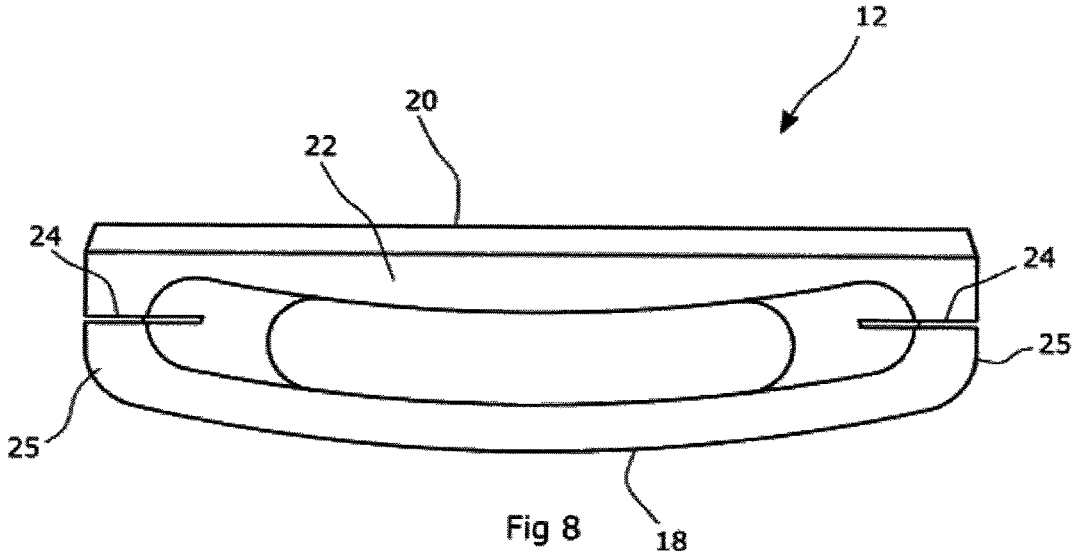
FIG. 8 is a top view of the block of the sounding block assembly according to a first embodiment of the present invention.

Embodiments comprise a idiophone assembly for attachment to the rim of a drum comprising a idiophone block or bell made of wood, metal or any other suitable material, one or more quick release drum rim clamps, and one or more fasteners and, as applicable, associated bosses for securing the clamps to the instrument Advantageously, the assembly can quickly and easily be secured to the rim of a drum and quickly and easily removed from the drum as desired. In some variations, rubber insulating spacers are provided that at least partially acoustically isolate the instrument from the drum.

The advantage of mounting an idiophone to the rim of the drum is it puts the instrument in a location the drummer is accustomed to and enables the drummer to expand on characteristic sound capabilities by enabling rapid alternate striking of the drum head and instrument, striking them both simultaneously creating a rimshot or setting one end of the drum stick on the drumhead while striking the instrument to create a cross stick.

Another embodiment of the present comprises a flexible drumstick that flexes appreciably when attempting a rimshot such that the tip makes contact with the head of the drum even when the angle of the stick relative to a simultaneous rim/sounding block and head strike is off a significant amount from optimum. This makes hitting a rimshot for a drummer easier and more predictable. The stick typically comprises a polymeric tubular shaft that is flexible, lightweight and more wear and break resistant than prior art wood sticks.

Embodiments of the flexible drumstick described herein also include a sliding tubular handle and two drumstick tips or striking ends. By sliding the handle from one end to another the opposing striking end or tip is exposed. Advantageously, two different sounds can be achieved using a single stick depending on what end is used. In variations, the tips comprise replaceable plugs.

Terminology

The terms and phrases as indicated in quotes (" ") in this section are intended to have the meaning ascribed to them in this Terminology section applied to them throughout this document including the claims unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive rather the term is inclusive meaning "either or both".

References in the specification to "one embodiment", "an embodiment", "a preferred embodiment", "an alternative embodiment" and similar phrases mean that a particular feature, structure, or characteristic described in connection with the embodiment is included in at least an embodiment of the invention. The appearances of the phrase "in one embodiment" in various places in the specification are not necessarily all meant to refer to the same embodiment.

The term "couple" or "coupled" as used in this specification and the appended claims refers to either an indirect or direct connection between the identified elements, components or objects. Often the manner of the coupling will be related specifically to the manner in which the two coupled elements interact.

Directional and/or relationary terms such as, but not limited to, left, right, nadir, apex, top, bottom, upper, lower, vertical, horizontal, back, front and lateral are relative to each other and are dependent on the specific orientation of an applicable element or article, and are used accordingly to aid in the description of the various embodiments and are not necessarily intended to be construed as limiting.

The term "idiophone" as used herein refers to an instrument that vibrates when struck to produce a sound, such as, but not limited to a block, a bell, a rattle or a gong.

An Embodiment of the Drum Mounted Idiophone Assembly

Embodiments of the idiophone block assembly and its various components are illustrated in FIGS. 1-16. An embodiment of the assembly attached to a drum is illustrated in FIGS. 17-20. The idiophone block assembly 10 typically comprises: (i) a block 12; (ii) two quick release clamps 14; and (iii) two threaded fasteners 16 to secure the clamps to the block.

The size, shape, configuration and construction of the block 12 can vary although in several embodiments it is comprised primarily of wood. Variations made of plastic, metal and other materials are also known. The block can be fabricated from a single piece of wood or can comprise a laminate.

The illustrated block 12 has a substantially isosceles trapezoid shaped front side 18 and similarly shaped rear side 20 with the top edges being longer than the bottom edges. The thickness of the block can vary depending on the nature of the sound the block is configured to produce. Further, the illustrated block is at least partially hollow and has an open top end 22. Slits 24 extend downwardly in the respective left and right sides 25 from the top side. The existence of the slits and their configuration also depends on the nature of the sound the block is configured to produce. As can be appreciated, solid blocks without slits are also contemplated. The shape of the block and the location of any interior features can vary as well.

Figure 9:
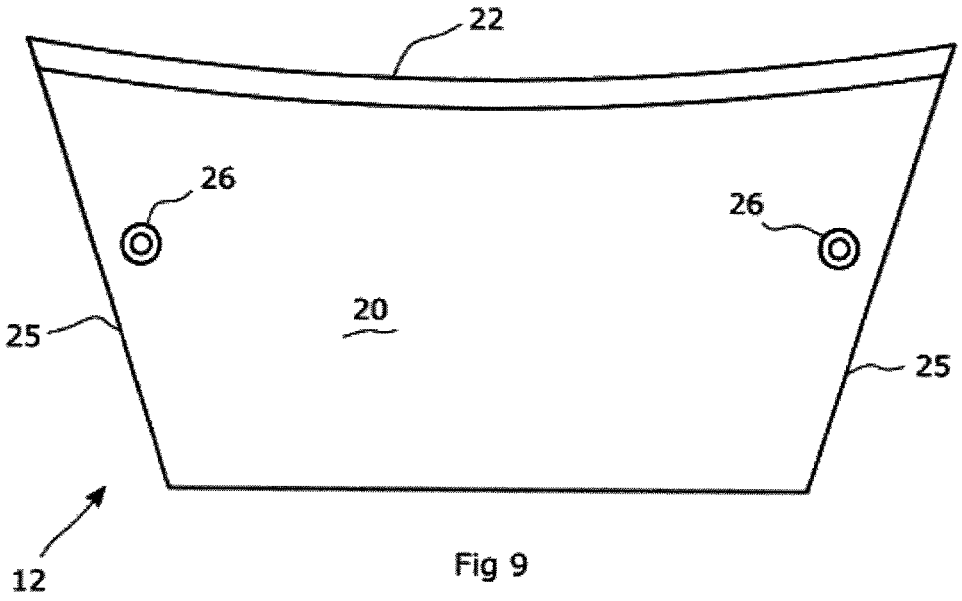
FIG. 9 is a rear view of the block of the sounding block assembly according to a first embodiment of the present invention.
Figure 10:
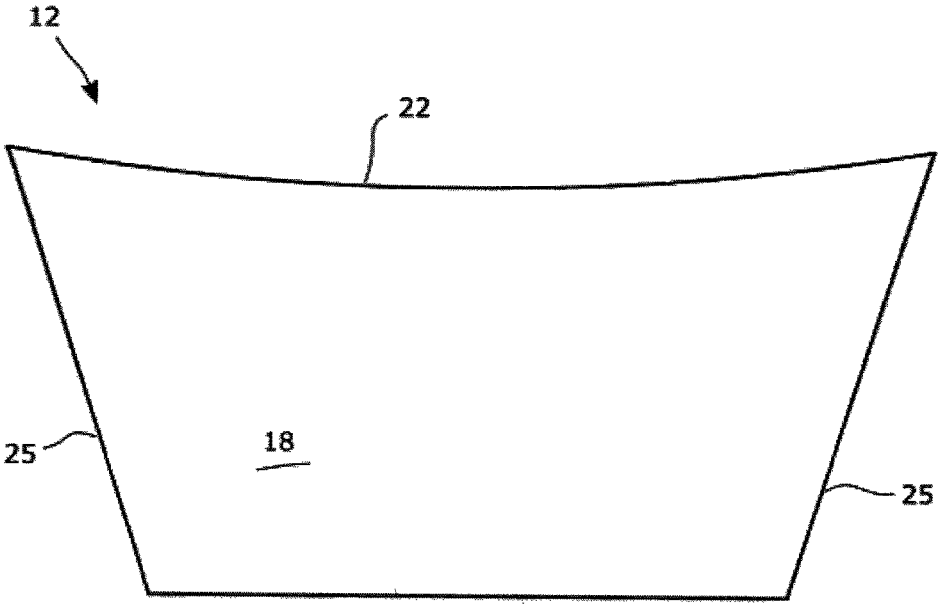
FIG. 10 is a front view of the block of the sounding block assembly according to a first embodiment of the present invention.
Figure 11:
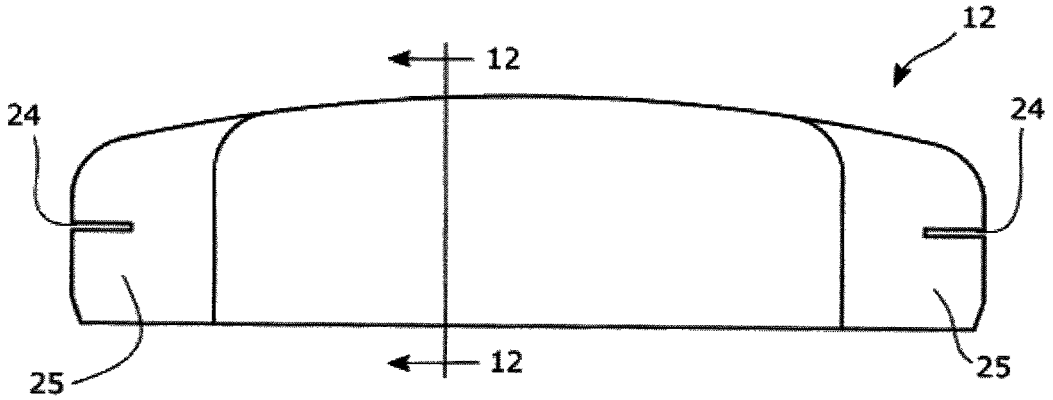
FIG. 11 is a bottom view of the block of the sounding block assembly according to a first embodiment of the present invention.
Figure 12:
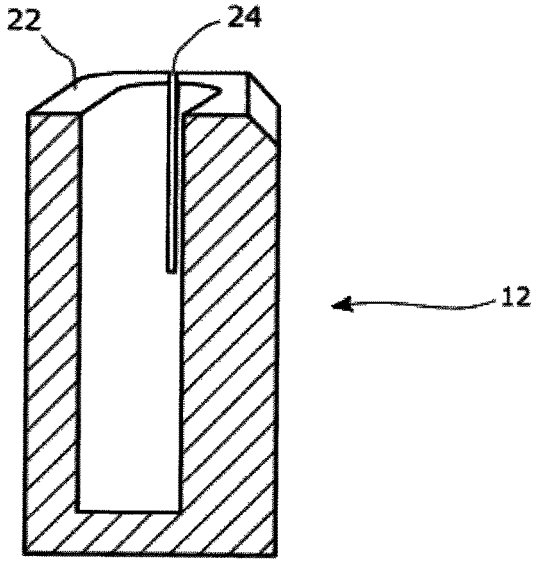
FIG. 12 is a cross sectional side view of the block of the sounding block assembly according to a first embodiment of the present invention.
Figure 13:
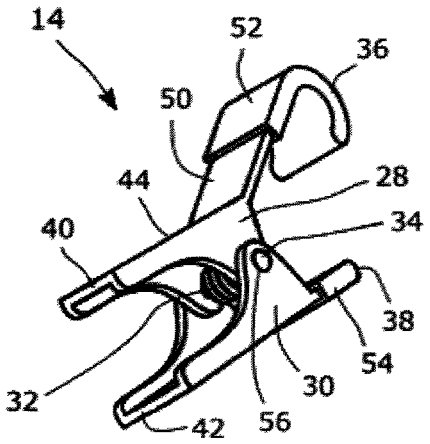
FIG. 13 is a front side view of a spring loaded clamp of the sounding block assembly according to a first embodiment of the present invention.
Figure 14:
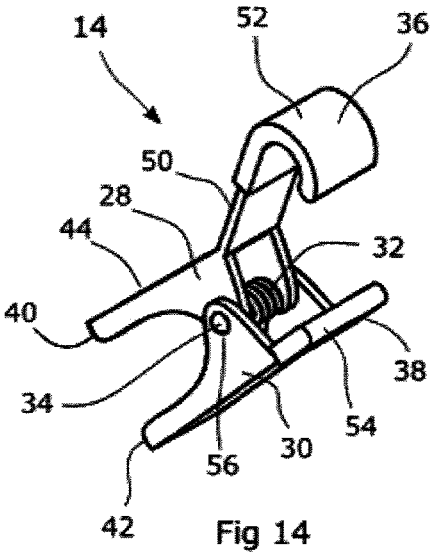
FIG. 14 is a rear side view of a spring loaded clamp of the sounding block assembly according to a first embodiment of the present invention.

As best seen in FIG. 9, the block has two threaded bosses 26 secured in its rear side. The bosses are typically made of metal but can be made of other materials as well. The bosses are configured to receive the threaded fasteners 16 that secure the clamps 14 to the block 12. In some variations, the fasteners are secured directly into the block and bosses are not utilized.

Figure 15:
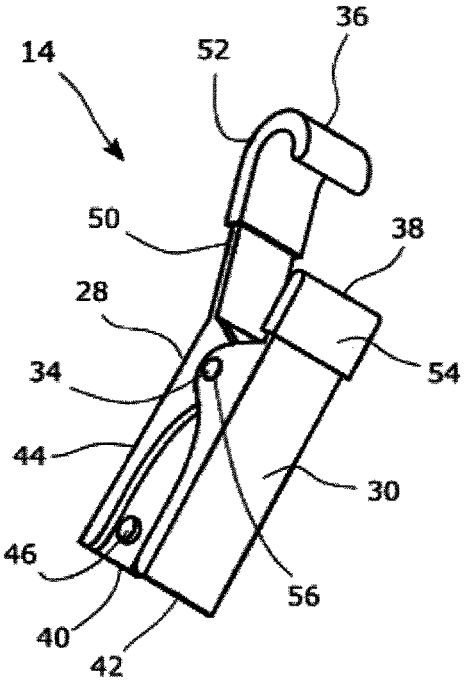
FIG. 15 is a perspective bottom side view of a spring loaded clamp of the sounding block assembly according to a first embodiment of the present invention.
Figure 16:
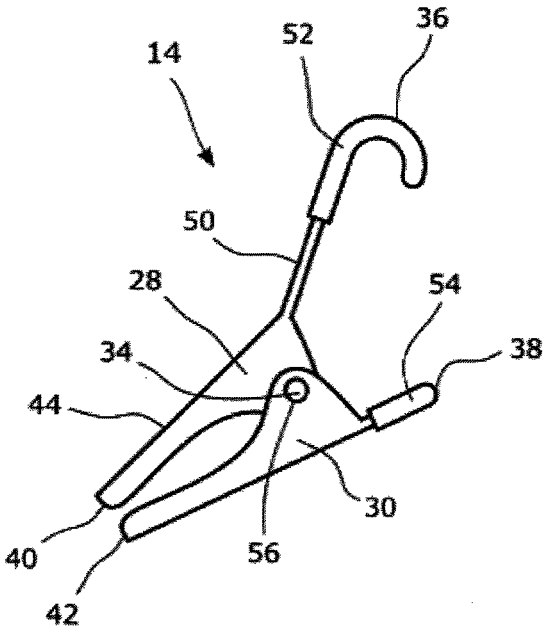
FIG. 16 is a side view of a spring loaded clamp of the sounding block assembly according to a first embodiment of the present invention.
Figure 17:
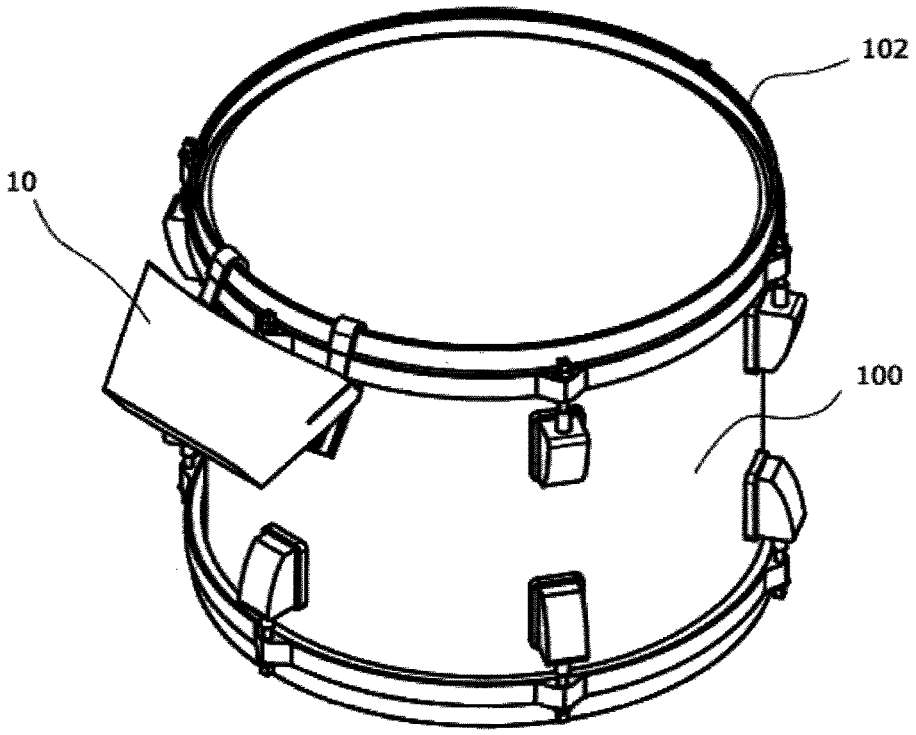
FIG. 17 is perspective top side view of a drum having the sounding block assembly attached according to a first embodiment of the present invention.
Figure 18:
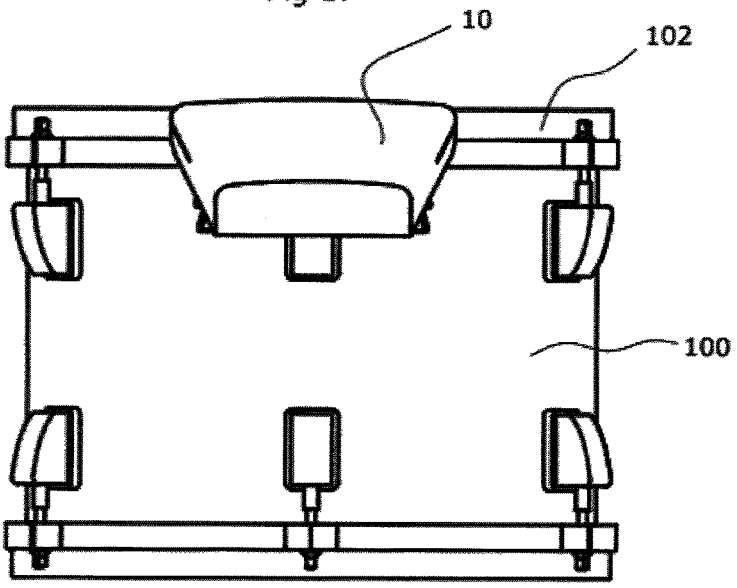
FIG. 18 is first side view of a drum having the sounding block assembly attached according to a first embodiment of the present invention.

In the illustrated embodiment two quick release clamps 14 are utilized. In variations, additional clamps can be used and variations with a single clamp are also contemplated. The clamp is best shown in FIGS. 13-16. The clamp, as shown, comprises a first lever arm 28, a second lever arm 30, a spring member 32 and a pivot rod 34. Each clamp is actuatable between a closed first position and an open second position by applying pressure and depressing the lever arms. The distance between the distal ends 36 & 38 of the arms in the second position is greater than the distance between the arms in the first position permitting the clamp to be easily placed over or removed from the rim of a drum. FIG. 16 illustrates the clamp in the second position, such as when the proximal ends 40 & 42 are depressed by a user.

The first lever arm 28, as well as the second lever arm 30, are typically fabricated from stamped steel although levers made of other materials, such as a reinforced or unreinforced plastic, are known. The first lever arm comprises a proximal portion 44 that terminates at the proximal end 40. The proximal portion is substantially linear and includes a bore 46 proximate the proximal end as best seen in FIG. 15, and a pair of aligned first lever arm holes (not shown) that are generally perpendicular to the bore. The bore is configured to receive a threaded fastener 16 there through to secure the clamp to the block 12. The holes are located close to the proximal portion's intersection with a distal portion 50 and are configured to receive the pivot rod 34 therein.

The distal portion 50 extends linearly away from its intersection with the proximal portion at an acute angle relative to the proximal portion and terminates at a distal end 36 that forms an annular hook. The hooked distal end is configured to grab and brace against the upper side of a drum rim 102 to secure the block assembly 10 in place.

Figure 19:
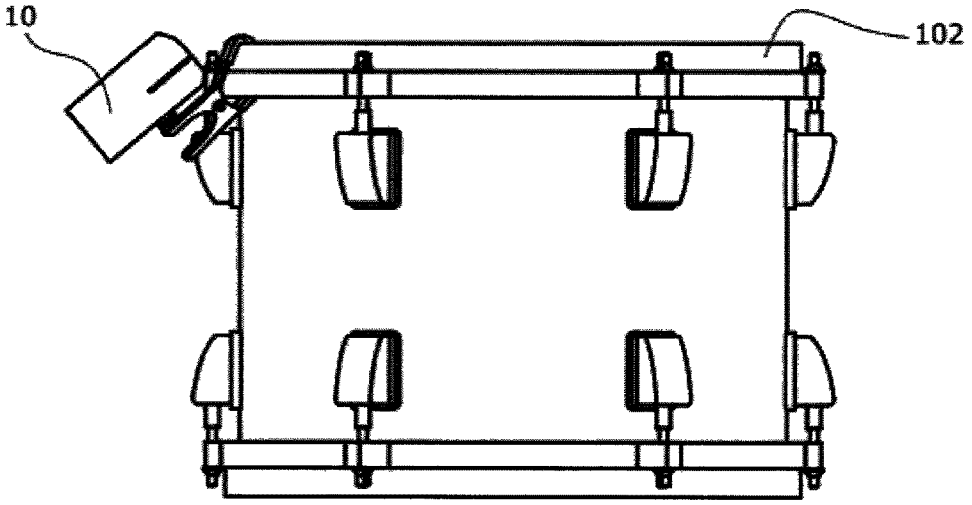
FIG. 19 is first side view of a drum having the sounding block assembly attached according to a first embodiment of the present invention.
Figure 20:
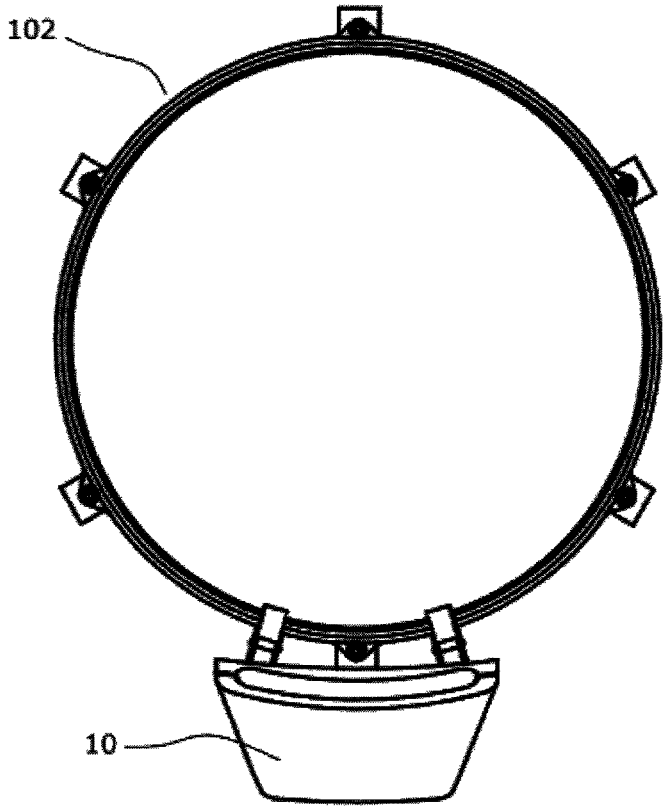
FIG. 20 is top view of a drum having the sounding block assembly attached according to a first embodiment of the present invention.
Figure 21D:
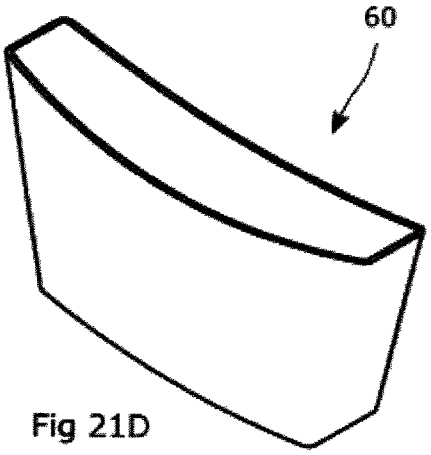
FIGS. 21A-D illustrate various views (rear perspective, rear, cross sectional view and front perspective respectively) of a bell to be used as part of an idiophone assembly in place of a sounding block according to a second embodiment of the present invention.
Figure 21B:
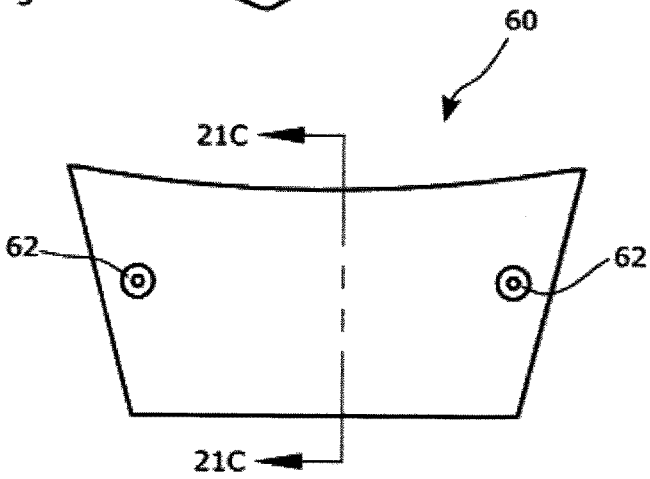
Figure 21C:
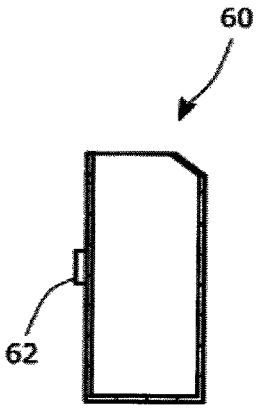
Figure 21A:
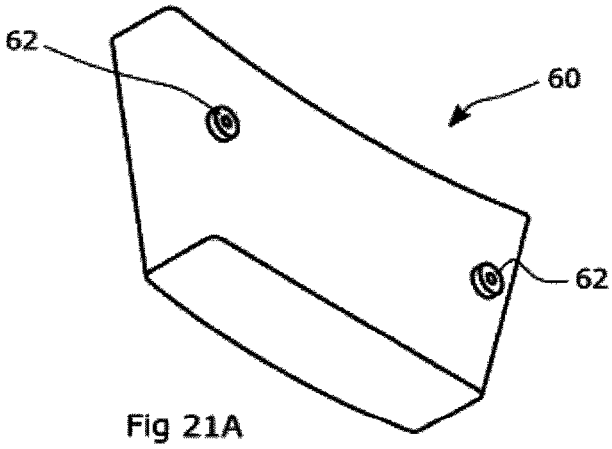

Of important note, the acute angle between the proximal and distal portions 44 & 50 places the block 12 at an angle relative to the horizontal striking surface of the drum 100 that is suited for effective block sound production as is best seen in FIG. 19.

The second lever arm 30 is substantially linear from its proximal end to its distal end 42 & 38. It includes a pair of second lever arm holes 56 in which the pivot rod 34 is received proximate the middle of the second lever arm. The distal end 38 is configured to interface with the bottom edge of the drum rim 102. As shown in the figures, the distal ends of both lever arms can be coated with a rubber or elastomeric coating 52 & 54 to prevent the metal ends from marring the drum at the points of connection therewith.

The first and second lever arms 28 & 30 are pivotally joined by the pivot rod 34, which passes through the first and second lever arm holes. The ends of the pivot rod are typically mushroomed to retain it in place. A spring member 32, typically comprising a torsion spring, is positioned on the pivot rod between the lever arm holes with ends that brace against the lever arms to hold the clamp in its first position. Other types of spring or biasing members, such as a leaf spring, can be specified as appropriate to serve a similar function.

The clamps 14 are attached to the block 12 by way of a pair of threaded fasteners 16 that pass through the bores 46 in the clamps and are received in the threaded bosses 26 of the block. In some variations a rubber, elastomeric or plastic insulating spacer 60 is provided and positioned over the threaded fasteners between the block and the clamp to provide a measure of sound dampening between the drum and the block. In some variations, the insulating spacer can be relatively thick (see FIG. 2 for example) wherein the thickness and flexibility of the insulating spacer permit the clamp to pivot angularly relative to the block several degrees to adjust to the curvature of the drum rim and help ensure that both clamps can securely attach thereto.

A Method of Using Embodiments of the Drum Mounted Idiophone Assembly

In use, embodiments of the Idiophone assembly 100 can be quickly and easily attached and removed from the rim 102 of a drum. To attach the assembly to a drum a user typically depresses the clamps, one with each hand, moving the clamps from the normally-biased first position into the second position actuating the one or more quick release clamps to move each from the first position to the second position. Next, the user hooks the hooked distal ends of the first lever arms over the rim of the desired drum and moves the distal end of the lower second lever arm in place beneath the rim. The clamps are released causing them to move from the second position towards the first position and apply a biasing force to the drum rim removably securing the idiophone assembly in place.

Once secured in place, the user or other drummer can strike the idiophone with his/her drum stick as desired while playing the drums. As desired, the idiophone assembly can be moved on the drum, removed from the drum and/or placed on another drum.

In some instances, drummers may have more than one idiophone assembly attached to a single drum or to various drums in a drum set. The assemblies can have different idiophones configured so that each make their own unique set of sounds when struck and placed in locations beneficial for cross stick and rimshot techniques.

An Embodiment of a Drum Mounted Idiophone Bell Assembly

FIGS. 21A-D illustrate a bell 60 that can be used in place of the block 12 in an idiophone assembly of the type described with reference to FIGS. 1-5. Except for the substitution of a bell for the block the other components and elements of the assembly are substantially similar.

The bell is typically comprised of a thin walled metal, such as but not limited to steel, brass, bronze, aluminum or copper, that forms a hollow structure typically with an open end. The bell can be comprised of other materials as well including certain plastics, composite materials and ceramics. Striking the bell with a stick typically causes it to resonate and omit a characteristic sound. The size and shape of the bell can vary dramatically depending on the type of sound it is intended to produce.

Threaded bosses 62 are provided on the back side of the bell to which clips 14 as illustrated in FIGS. 13-16 can be attached to facilitate attachment of the bell assembly to a drum in manner analogous to the manner in which the idiophone sounding block assembly is mounted to a drum as shown in FIGS. 17-20.

An Embodiment of a Flexible Drum Stick

Figure 22A:
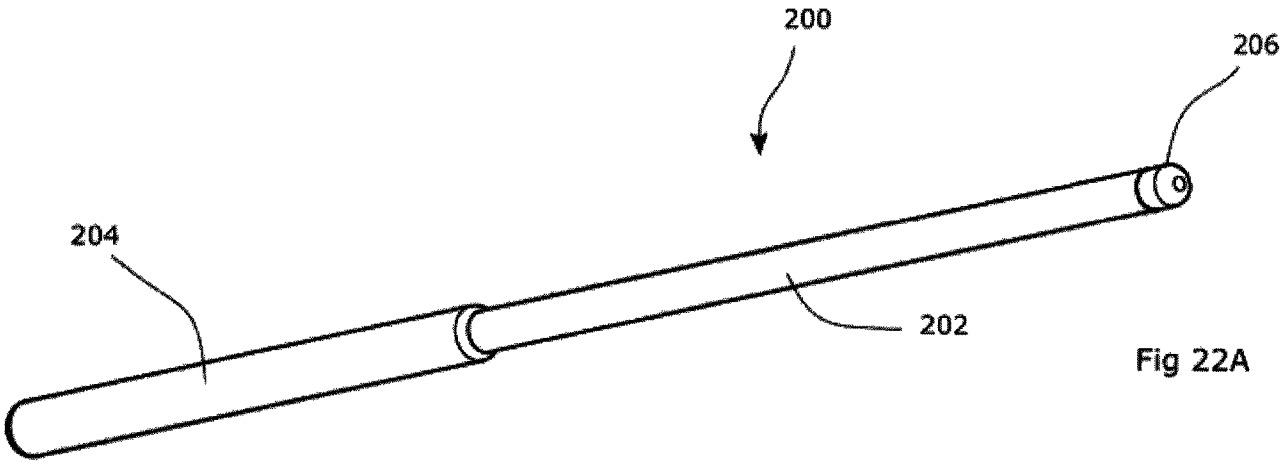
FIG. 22A&B illustrate two perspective front views of a flexible drum stick with a handle slid to a left end and right end respectively revealing two different stick striking tips or ends according to a third embodiment of the present invention.

An embodiment of a flexible drum stick 200 is illustrated in FIGS. 21-22A&B. With reference to all three figures, the stick comprises: (i) a cylindrical tubular primary shaft 202 typically comprised of a polymeric material; (ii) one or more drum tip plugs 206 secured in one or both ends of the primary shaft; and a (iii) slidable tubular handle 204 also typically comprised of a polymeric material. In some variations and as shown in FIG. 23, a secondary shaft 210 is provided that is received in the tubular interior of the primary shaft.

One variation of the primary shaft 204 has an outside diameter of about 0.38" and an inside diameter of 0.25", is about 16" long and is comprised of polycarbonate, which in tubular form provides a significant and suitable degree of flex when the stick is used in an intended fashion. The length, and inner and outer diameters of the shaft can vary depending on the desired characteristics of the resulting stick. Further, the shaft can be made of other suitable polymeric and non-polymeric materials.

The tubular handle 204 has an inside diameter substantially similar to the outside diameter of the primary shaft 202 forming a tight interface wherein the handle can be slid from one end of the primary shaft to another with the application of sufficient force to overcome the interference friction, but remain fixed in place on the shaft during drum play. In some variations, features can be provided at selective locations on the outside surface of the primary shaft and the inside surface of the tubular handle, such as protrusions and indentations, to assist in securing the handle in place on either end of the primary shaft. One variation of the tubular handle has a length of about 7" and an outside diameter of about 0.50" providing a suitable gripping surface for a drummer. The tubular handle typically made of a polymeric material although handles made of other materials such as wood are contemplated. Further, the outer surface of the handle can be coated or covered to enhance the drummer's grip on the stick.

Figure 22B:
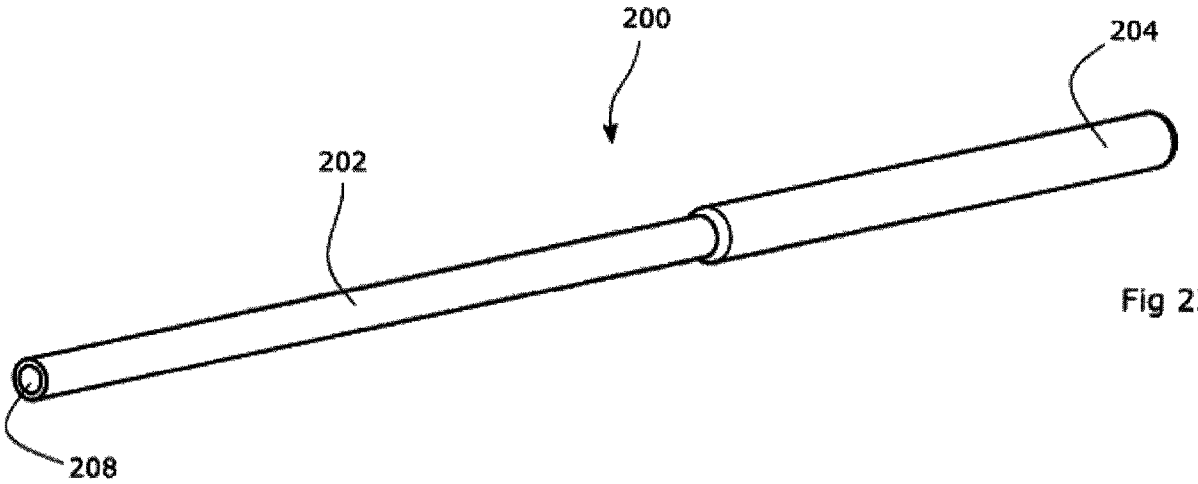
Figure 23:
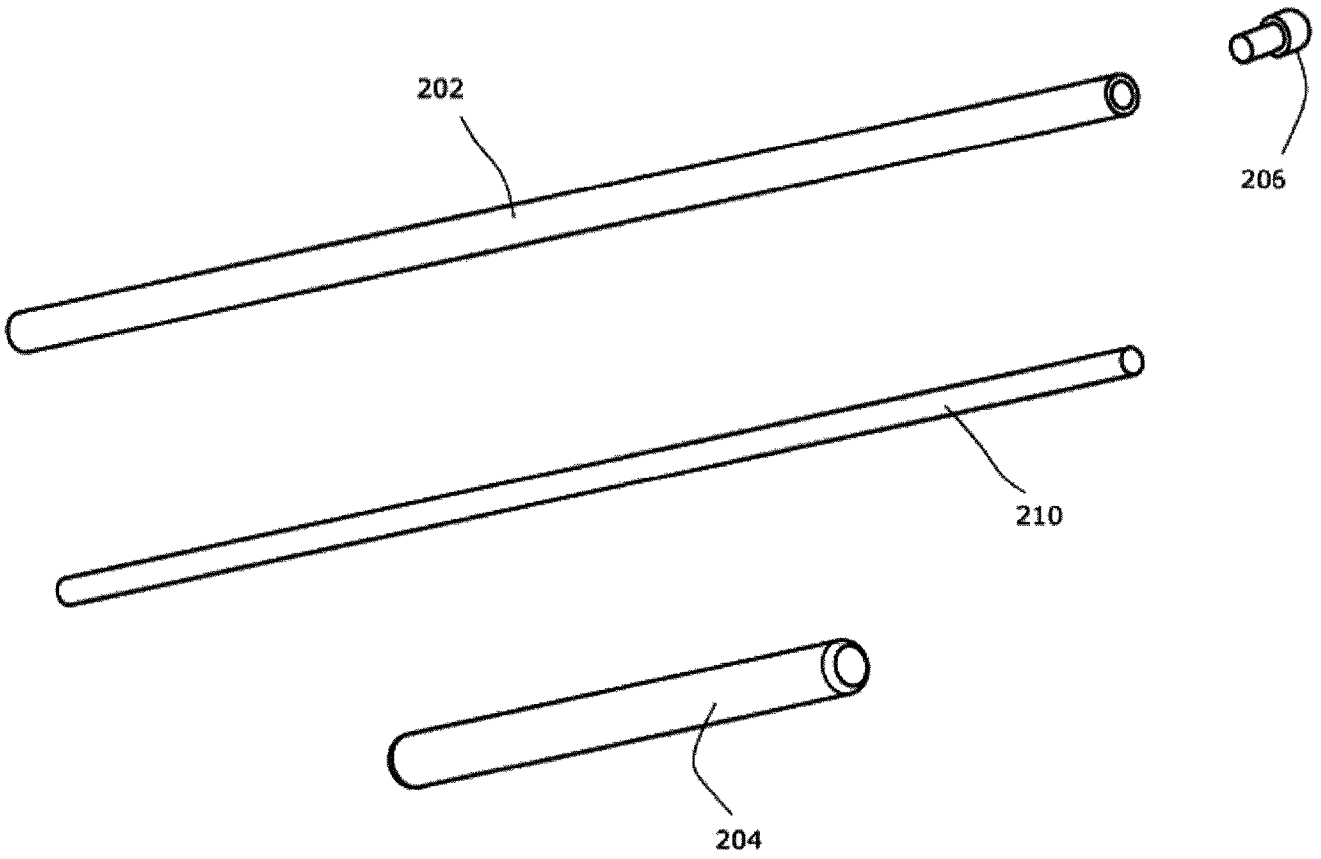
FIG. 23 is an exploded perspective view of the flexible drum stick according to the third embodiment of the present invention.

The edges of each end of the primary shaft 202 can be rounded and serve as a striking end, such as the left end of the stick illustrated in FIG. 22B; however, in many variations a drum tip plug 206 is secured in the end of the primary shaft, such as the right end of the stick illustrated in FIG. 22A. The plug can be made of any suitable material including wood, plastic, metal, ceramic and natural materials depending on the nature of the sound the stick is configured to facilitate. Further, the shape of the tip can vary. Typically, the tip will comprise a hemispherical end but variations that are flat, ovular, have smaller or larger diameters, and comprise bristles are all contemplated. The tip plugs can be frictionally fit, screwed or adhesively secured into the end of the primary shaft. The tip plugs can also be configured for easy removability and replacement. By having different plugs located on each end of a stick, or in the illustrated stick having one end without a plug and one with, the drummer can select which end to play depending on the sound he/she is trying to achieve by simply sliding the tubular handle to the other end.

In some variations, a secondary shaft 210 can be specified that is received inside of the primary shaft. The secondary shaft is typically solid and can be made of any suitable material, such as wood. By adding a secondary shaft the weight and the stiffness of the stick can be varied to accommodate various styles and volume dynamics as may be desired by a particular drummer. The secondary shaft can be freely, frictionally or adhesively received within the tubular primary shaft. In some variations, the secondary shaft may be removable to allow the drummer to alter the playing characteristics of the stick.

Figure 24:
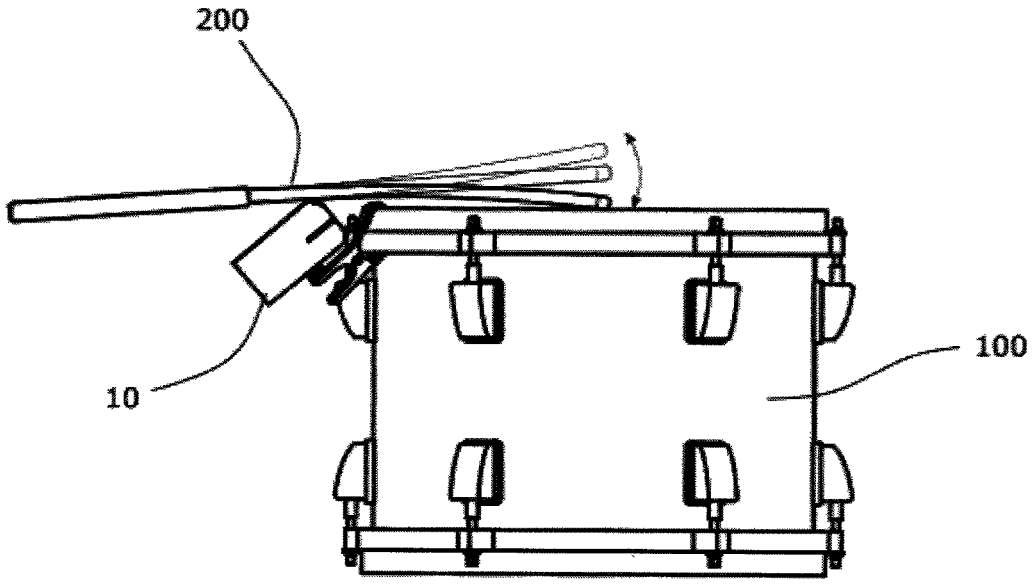
FIG. 24 is an illustration showing how the flexible drum stick can be used to hit both the idiophone assembly and the surface of the drum in a single strike according to an embodiment of the present invention.

FIG. 24 illustrates an embodiment of the flexible stick 200 hitting both a idiophone block assembly 10 and the head of a drum 100 nearly simultaneously to create a rimshot. As can be seen, the angle of the stick as it hits the idiophone block is less critical than with a more rigid stick as the primary shaft of the stick flexes appreciably until the tip hits the head.

Other Embodiments and Variations of the Drum Mounted Idiophone Assembly and Flexible Drum Stick The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

I claim:

1. An idiophone assembly for attachment to the rim of a drum, the assembly comprising:

an idiophone adapted to be struck by a stick and generate an audible sound;

one or more quick release clamps, each clamp including (i) a bore, (ii) first and second lever arms pivotally coupled and biased in a first closed position wherein distal ends of the first and second lever arms are a first distance apart and actuatable into a second open position when pressure is applied wherein the distal ends are a second distance apart, the second distance being greater than the first distance, and (iii) a spring member, the spring member biasing the first and second lever arms in the closed position; and one or more fasteners, each fastener being received through a bore in an associated quick release clamp of the one or more quick release clamps and securely received in the idiophone assembly;

wherein the distal end of the first lever arm of each one or more quick release clamps includes a curved hook and the distal end of the second lever arm of each one or more quick release clamps is substantially straight and linear, the first lever arm being adapted to hang over the top edge of a rim of the drum, and the lower arm being adapted to brace against the bottom edge of the rim.

2. The idiophone assembly of claim 1, wherein the idiophone comprises a block and is comprised primarily of wood.

3. The idiophone assembly of claim 1, wherein the idiophone comprises a block and has a substantially isosceles trapezoid front and rear side shape with a longer top side and an opposing shorter bottom side with the front and rear sides being spaced apart a thickness.

4. The idiophone assembly of claim 1, wherein the idiophone comprises a block and the block is at least partially hollow.

5. The idiophone assembly of claim 1, further including one or more threaded bosses, the threaded bosses being received in and secured to a rear side of the idiophone assembly and being adapted to receive the one or more fasteners therein.

6. The idiophone assembly of claim 1, further including one or more elastomeric insulating spacers, a insulating spacer of the one or more elastomeric insulating spacers being received over the one or more fasteners between the idiophone assembly and the one or more clamp assemblies.

7. The idiophone assembly of claim 1, wherein the first lever arm is significantly longer than the second lever arm.

8. The idiophone assembly of claim 1, wherein the one or more quick release clamps comprise two quick release clamps, and the one or more fasteners comprise two fasteners.

9. A combination comprising the drum and the idiophone assembly of claim 1 attached thereto.

10. A method of using the idiophone assembly of claim 1, the method comprising:

actuating the one or more quick release clamps to move each from the first position to the second position;

placing the first and second lever arms on a rim of the drum; and releasing the one or more quick release clamps causing the clamps to return towards the first position and become removably secured to the rim of the drum.

11. The method of claim 10, further comprising striking the idiophone assembly with a drum stick while playing the drum.

12. An idiophone assembly for attachment to the rim of a drum, the assembly comprising:

an idiophone adapted to be struck by a stick and generate an audible sound;

one or more quick release clamps, each clamp including (i) a bore, (ii) first and second lever arms pivotally coupled and biased in a first closed position wherein distal ends of the first and second lever arms are a first distance apart and actuatable into a second open position when pressure is applied wherein the distal ends are a second distance apart, the second distance being greater than the first distance, and (iii) a spring member, the spring member biasing the first and second lever arms in the closed position; and one or more fasteners, each fastener being received through a bore in an associated quick release clamp of the one or more quick release clamps and securely received in the idiophone assembly;

wherein the first lever arm of each one or more quick release clamps comprises a proximal portion and a distal portion, the proximal portion being substantially linear and including the bore proximate a proximal end and a pair of aligned first lever arm through holes generally perpendicular to the bore in which a pivot rod is received therein proximate a distal end of the proximal portion, the distal portion extends linearly away from an intersection with the proximal portion at an acute angle relative to the proximal portion, the distal end being on the distal portion and including a curved hook.

13. The idiophone assembly of claim 12, wherein the second lever arm is substantially linear from its proximal end to its distal end and includes a pair of second lever arm through holes in which the pivot rod is received proximate a middle portion of the second lever arm.

14. The idiophone assembly of claim 13, wherein the spring member is a torsion spring and the spring member is received around the pivot rod.

15. A combination comprising the drum and the idiophone assembly of claim 12 attached thereto.

16. An idiophone assembly for attachment to the rim of a drum, the idiophone assembly comprising:

a substantially wood, metal or plastic block, the block adapted to be struck by a stick to generate an audible sound, the block is at least partially hollow and has a substantially isosceles trapezoid front and rear side shape with a longer top side and an opposing shorter bottom side with the front and rear sides being spaced apart a thickness, the block further including two threaded bosses, the threaded bosses being received in or on and secured to a rear side of the block;

two quick release clamps, each clamp including (i) a bore, (ii) first and second lever arms pivotally coupled and biased in a first closed position wherein distal ends of the first and second lever arms are a first distance apart and actuatable into a second open position when pressure is applied wherein the distal ends are a second distance apart, the second distance being greater than the first distance, and (iii) a spring member, the spring member biasing the first and second lever arms in the closed position;

two threaded fasteners, each fastener being received through a bore in an associated quick release clamp of the two quick release clamps and threadably received in a threaded boss of the threaded bosses; and two elastomeric insulating spacers, each insulating spacer of the two elastomeric insulating spacers being received over a fastener of the two fasteners between the block and an associated quick release clamp assembly of the two clamp assemblies.

17. The idiophone assembly of claim 16, wherein:

the first lever arm of each of the two quick release clamps comprises a proximal portion and a distal portion, the proximal portion being substantially linear and including the bore proximate a proximal end and a pair of aligned first lever arm through holes generally perpendicular to the bore in which a pivot rod is received therein proximate a distal end of the proximal portion, the distal portion extends linearly away from an intersection with the proximal portion at an acute angle relative to the proximal portion, the distal end being on the distal portion and including a curved hook;

the second lever arm is substantially linear from its proximal end to its distal end and includes a pair of second lever arm through holes in which the pivot rod is received proximate a middle portion of the second lever arm; and the spring member is a torsion spring and the spring member is received around the pivot rod.

18. A combination comprising the drum and the idiophone assembly of claim 17 attached thereto.

19. A method of using the idiophone assembly of claim 17, the method comprising:

depressing the first and second lever arms of each clamp of the two quick release clamps to move each clamp from the first position to the second position;

hooking the distal end of the first lever of each clamp around the rim of the drum; and releasing the first and second levers arms causing the lever arms to return towards the first position and secure the idiophone assembly to the drum.

* * * * *